US007638089B2

(12) United States Patent
Chan et al.

(10) Patent No.: US 7,638,089 B2
(45) Date of Patent: Dec. 29, 2009

(54) MAGNESIUM ALLOY AND THIN WORKPIECE MADE OF THE SAME

(75) Inventors: Kam-Shau Chan, Taipei Hsien (TW); Cheng-Shi Chen, Taipei Hsien (TW); Wen-Hsien Tang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/936,766

(22) Filed: Nov. 7, 2007

(65) Prior Publication Data

US 2008/0292901 A1 Nov. 27, 2008

(30) Foreign Application Priority Data

May 24, 2007 (CN) ..... 2007 1 0200690

(51) Int. Cl.
*C22C 23/04* (2006.01)

(52) U.S. Cl. ..... 420/409; 148/420

(58) Field of Classification Search ..... 148/420; 420/409

See application file for complete search history.

(56) References Cited

U.S. PATENT DOCUMENTS 6,511,560 B2 * 1/2003 Seki et al. ..... 148/667

FOREIGN PATENT DOCUMENTS

DE 10051525 * 5/2002
JP 2005281848 * 10/2005

* cited by examiner

*Primary Examiner*—Sikyin Ip
(74) *Attorney, Agent, or Firm*—Frank R. Niranjan

(57) ABSTRACT

An exemplary magnesium alloy includes: by weight, magnesium as a main ingredient, aluminum in an amount from 7.5% to 7.8%, zinc in an amount from 0.35% to 1.0%, manganese in an amount from 0.15% to 0.5%, silicon less than 0.1%, copper less than 0.03%, iron less than 0.005%, and nickel less than 0.002%. The present invention also provides a thin workpiece made of the magnesium alloy.

8 Claims, 2 Drawing Sheets

MAGNESIUM ALLOY AND THIN WORKPIECE MADE OF THE SAME

BACKGROUND OF THE INVENTION

1. Field of the Invention

The present invention generally relates to a magnesium alloy and, particularly, to a thin workpiece made of magnesium alloy.

2. Discussion of the Related Art

Magnesium is a metal that is the lightest in weight among metal materials. Magnesium alloys are composed of the magnesium and other metals, such as aluminum and zinc. In recent years, there has been an increase in demand for magnesium alloys used as structural materials for computers, mobile phones, and other electronic products.

For example, AZ91D magnesium alloy is widely used in electronic products. The AZ91D magnesium alloy includes magnesium as a main ingredient, in addition, the AZ91D magnesium alloy also includes, aluminum in an amount by weight from 8.3% to 9.7%, zinc in an amount by weight from 0.45% to 0.9%, manganese in an amount by weight from 0.17% to 0.4%, and some silicon, copper, iron, and impurities. In the AZ91D magnesium alloy, aluminum is use to modify the mechanical strength, the corrosion resistance, and the castability of the AZ91D magnesium alloy. A strengthening phase of the AZ91D magnesium alloy is generally obtained from $Mg_{12}Al_{17}$ eutectic phase. However if the AZ91D magnesium alloy is heated, a lot of $Mg_{12}Al_{17}$ eutectic phases may separate out to grain boundaries, thereby increasing brittleness of the AZ91D magnesium alloy. Thus, if thin workpieces used in electronic products, such as frames, that require excellent toughness, the AZ91D magnesium alloy would not meet the requirements.

Therefore, a new magnesium alloy and thin workpiece made of the magnesium alloy are desired in order to overcome the above-described shortcomings.

SUMMARY

A magnesium alloy includes: by weight, magnesium as a main ingredient, aluminum in an amount from 7.5% to 7.8%, zinc in an amount from 0.35% to 1.0%, manganese in an amount from 0.15% to 0.5%, silicon less than 0.1%, copper less than 0.03%, iron less than 0.005%, and nickel less than 0.002%.

A thin workpiece made of magnesium alloy. The magnesium alloy includes: by weight, magnesium as a main ingredient, aluminum in an amount from 7.5% to 7.8%, zinc in an amount from 0.35% to 1.0%, manganese in an amount from 0.15% to 0.5%, silicon less than 0.1%, copper less than 0.03%, iron less than 0.005%, and nickel less than 0.002%.

Other novel features will become more apparent from the following detailed description, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present thin workpiece made of magnesium alloy. Moreover, in the drawings, like reference numerals designate corresponding parts throughout several views, and all the views are schematic.

DETAILED DESCRIPTION OF THE EMBODIMENTS

Figure 1:
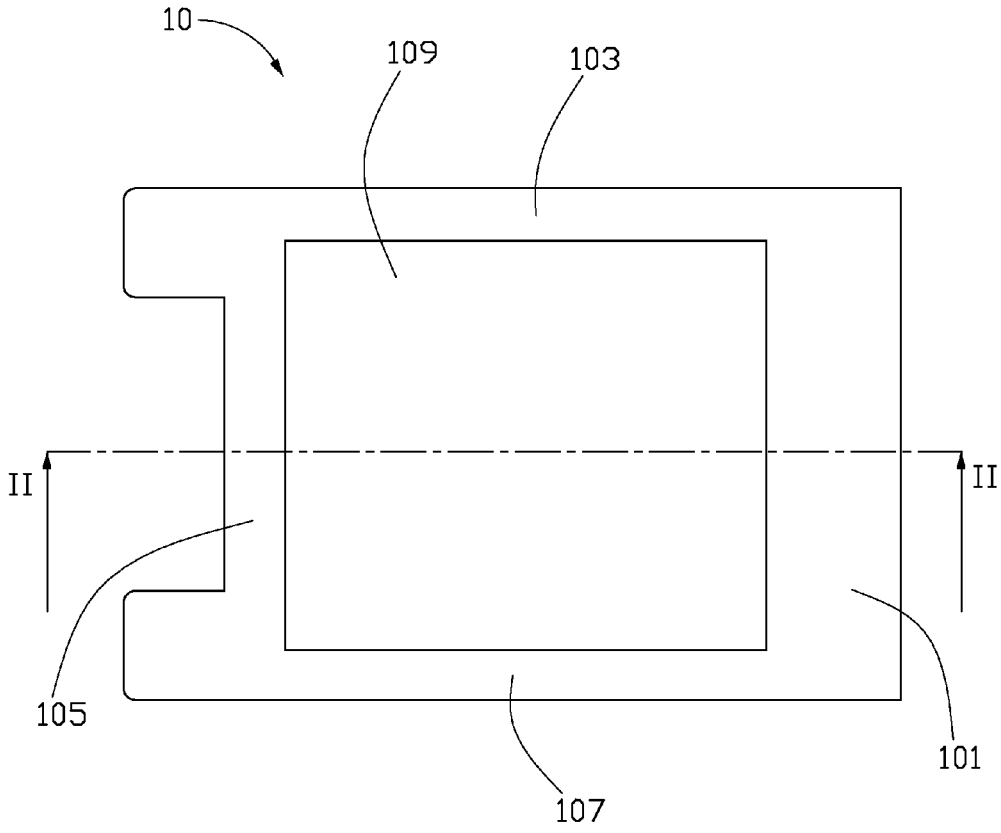
FIG. 1 is a top plan view of a thin workpiece in accordance with a preferred embodiment of the present invention.

Reference will now be made to the drawings to describe preferred embodiments of the present magnesium alloy and a thin workpiece made of the magnesium alloy in detail.

A magnesium alloy according to a preferred embodiment includes magnesium as a main ingredient, preferably, in an amount by weight from 90.543% to 92%. The magnesium alloy also includes, by weight, aluminum in an amount from 7.5% to 7.8%, zinc in an amount from 0.35% to 1.0%, manganese in an amount from 0.15% to 0.5%, silicon less than 0.1%, copper less than 0.03%, iron less than 0.005%, and nickel less than 0.002%. In an alternative embodiment, the magnesium alloy can further include impurities in an amount by weight less than 0.02%.

In this embodiment, since the amount of aluminum in the magnesium alloy is relatively low, an amount of the $Mg_{12}Al_{17}$ eutectic phases in the magnesium alloy is reduced. That way, while heating the magnesium alloy, occurrences of separation of the $Mg_{12}Al_{17}$ eutectic phases to grain boundaries is reduced, and also inhibiting any increase in brittleness and ensuring the magnesium alloy having excellent toughness. Furthermore, a magnesium alloy with greater than 7.5% aluminum in an amount by weight would have good castability properties, so the magnesium alloy of this embodiment having 7.5%-7.8% of aluminum in an amount by weight would have excellent castability properties.

A toughness test is performed on two AZ91D magnesium alloy samples and three AZ91D magnesium alloy samples. The test result of the toughness test is listed in Table 1 below. Sample a0, a1 are the two AZ91D magnesium alloys, and samples a2, a3, a4 are the three magnesium alloys according to the embodiment of the present invention prepared by modifying the amount of aluminum in the AZ91D magnesium alloy. A shape of each of the samples a0, a1, a2, a3, a4, a5 is a cuboid, and the length, width, and height of each of the five samples are 55 millimeters, 10 millimeters, and 10 millimeters respectively. Generally, how much energy a material absorbs reflects the impact strength of the material and further reflects the toughness, i.e. the more energy the material absorbs the higher the impact strength and better toughness of the material.

TABLE 1

| Sample no. | Sample description | Absorbed energy(J) |
|---|---|---|
| a0 | AZ91D magnesium alloy having aluminum in the amount by weight 8.25% | 16.64 |
| a1 | AZ91D magnesium alloy having aluminum in the amount by weight 8.96% | 13.80 |
| a2 | the magnesium alloy according to the embodiment of the present invention having aluminum in the amount by weight 7.51% | 23.38 |
| a3 | the magnesium alloy according to the embodiment of the present invention having aluminum in the amount by weight 7.64% | 23.99 |
| a4 | the magnesium alloy according to the embodiment of the present invention having aluminum in the amount by weight 7.74% | 23.15 |

As seen from the test results, the magnesium alloys according to the embodiment of the present invention absorbs more energy than the AZ91D magnesium alloys. Therefore the magnesium alloys according to the embodiment of the present invention have excellent toughness.

Furthermore, in order to determine when the magnesium alloy according to the embodiment of the present invention is used as a thin workpiece also has excellent toughness, some thin workpieces made of the magnesium alloy according to the embodiment of the present invention having special structures and some thin workpieces made of the AZ91D magnesium alloy having special structures are tested correspondingly.

Figure 2:
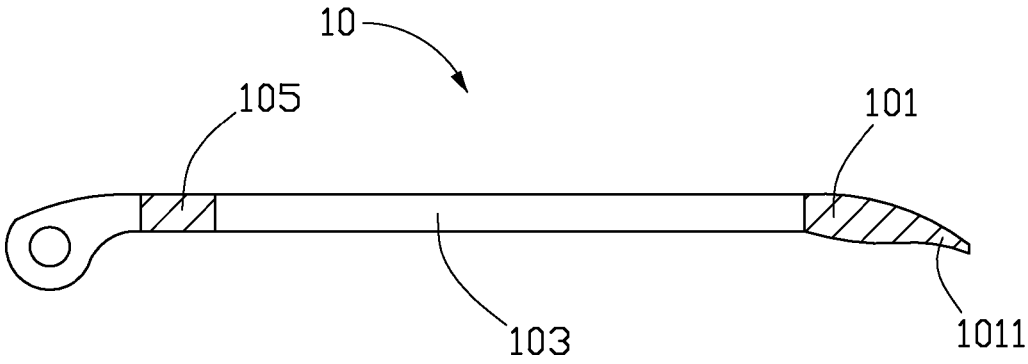
FIG. 2 is a side, cross-sectional view of the thin workpiece of FIG. 1, taken along line II-II thereof.

An example of the thin workpiece 10 made of the magnesium alloy according to the embodiment of the present invention or made of the AZ91D magnesium alloy is shown in FIGS. 1 and 2. The thin workpiece 10 can be used as a frame of the portable electronic product, such as mobile phone. The thin workpiece 10 is substantially a rectangular frame in shape. A thickness of the thin workpiece 10 can be in a range from about 0.5 millimeters to about 1 millimeter. The thin workpiece 10 includes a first side rim 101, a second side rim 103, a third side rim 105, and a fourth side rim 107. The first side rim 101 and the third side rim 105 are on opposite sides of the thin workpiece. The second side rim 103 or the fourth side rim 107 is connected to the first side rim 101 and the third side rim 105. The four side rims 101, 103, 105, and 107 cooperatively define an opening 109. An outer end of the first side rim 110 has a bent portion 1011 extending outwards. The bent portion 101 is curved. The thin workpiece 10 is molded by die-casting, then heated for 20 minutes at 120 degrees centigrade, and then the surfaces of the thin workpiece 10 are treated for 30 minutes at 150 degrees centigrade.

A drop test is performed on the thin workpiece 10 to determine the toughness of the thin workpieces 10. While testing, the thin workpieces 10 made of the magnesium alloy according to the embodiment of the present invention or made of the AZ91D magnesium alloy is dropped such that the bent portion 1011 of the first side rim 101 hits the ground first. A toughness of the thin workpiece 10 made of magnesium alloy according to the embodiment of the present invention or the AZ91D magnesium alloy is defined by the average drop count before the bent portion 1011 becomes fractured. From the test, an average drop count of the thin workpieces 10 made of the AZ91D magnesium alloy is 2.5, and the average drop count of the thin workpieces 10 made of the magnesium alloy according to the embodiment of the present invention is 4.5. Thus, the thin workpieces 10 made of the magnesium alloy according to the embodiment of the present invention have better toughness than that made of the AZ91D magnesium alloy.

It is noted that the scope of the present magnesium alloy and thin workpiece made of the magnesium alloy are not limited to the embodiments described above. For example, the structure of the thin workpiece 10 can be a cover having no opening thereon.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A magnesium alloy consisting of: by weight, magnesium as a main ingredient, aluminum in an amount from 7.5% to 7.8%, zinc in an amount from 0.35% to 1.0%, manganese in an amount from 0.15% to 0.5%, silicon less than 0.1%, copper less than 0.03%, iron less than 0.005%, nickel less than 0.002%, and impurities less than 0.02%.

2. The magnesium alloy as claimed in claim 1, wherein the magnesium is in an amount by weight from 90.543% to 92%.

3. A thin workpiece made of magnesium alloy, wherein the magnesium alloy consisting of: by weight, magnesium as a main ingredient, aluminum in an amount from 7.5% to 7.8%, zinc in an amount from 0.35% to 1.0%, manganese in an amount from 0.15% to 0.5%, silicon less than 0.1%, copper less than 0.03%, iron less than 0.005%, nickel less than 0.002%, and impurities less than 0.02%.

4. The thin workpiece as claimed in claim 3, wherein the magnesium is in an amount by weight from 90.543% to 92%.

5. The thin workpiece as claimed in claim 3, wherein a thickness of the thin workpiece is in a range from about 0.5 millimeters to about 1 millimeter.

6. The thin workpiece as claimed in claim 3, wherein the thin workpiece is substantially a rectangular frame in shape.

7. The thin workpiece as claimed in claim 6, wherein the thin workpiece comprises four connecting side rims, and an outer end of one of the four connecting side rims has a bent portion extending outwards.

8. The thin workpiece as claimed in claim 7, wherein the bent portion is curved.

* * * * *